US010000079B2

(12) United States Patent
Ikemoto et al.

(10) Patent No.: US 10,000,079 B2
(45) Date of Patent: Jun. 19, 2018

(54) PRINTING DEVICE INCLUDING HOLDER SUPPORTING PLATEN ROLLER THROUGH BEARINGS

(71) Applicant: BROTHER KOGYO KABUSHIKI KAISHA, Nagoya, Aichi (JP)

(72) Inventors: Yusuke Ikemoto, Nagoya (JP); Takehiko Inaba, Aichi-ken (JP); Hidenori Jo, Nagoya (JP); Ryuichi Kanda, Nagoya (JP); Yuki Nagashima, Toyokawa (JP); Hitoshi Sanada, Nagoya (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days. days.

(21) Appl. No.: 15/666,955

(22) Filed: Aug. 2, 2017

(65) Prior Publication Data

US 2018/0086119 A1 Mar. 29, 2018

(30) Foreign Application Priority Data

Sep. 23, 2016 (JP) ..... 2016-185034

(51) Int. Cl.

| | |
|---|---|
| ***B41J 11/04*** | (2006.01) |
| ***B41J 13/02*** | (2006.01) |
| *B41J 15/04* | (2006.01) |
| *B41J 11/44* | (2006.01) |
| *B41J 11/36* | (2006.01) |
| *B41J 13/036* | (2006.01) |

(52) U.S. Cl.

CPC ..... *B41J 13/02* (2013.01); *B41J 11/04* (2013.01); *B41J 11/36* (2013.01); *B41J 11/44* (2013.01); *B41J 13/036* (2013.01); *B41J 15/042* (2013.01)

(58) Field of Classification Search

CPC . B41J 13/02; B41J 11/04; B41J 13/036; B41J 11/44; B41J 11/36; B41J 15/042

See application file for complete search history.

(56) References Cited

U.S. PATENT DOCUMENTS

2002/0018666 A1* 2/2002 Noda ..... F16D 1/101 399/90
2003/0123904 A1* 7/2003 Maeshima ..... G03G 15/757 399/167

FOREIGN PATENT DOCUMENTS

JP 2015-160427 A 9/2015
JP 2015-208920 A 11/2015

* cited by examiner

*Primary Examiner* — Yaovi M Ameh
(74) *Attorney, Agent, or Firm* — Scully, Scott, Murphy & Presser, PC

(57) ABSTRACT

A printing device includes a platen roller, a pair of bearings, and a holder including a pair of fitting portions to which the bearings are fitted. The bearings rotatably support a rotational shaft of the platen roller. Each bearing includes a small-diameter portion, a large-diameter portion coaxially connected to the small-diameter portion, and a protrusion provided at an outer circumferential surface of the small-diameter portion. The larger-diameter portion has a peripheral surface and an end face connecting the peripheral surface to the outer circumferential surface. Each fitting portion includes: a receiving portion configured to receive the small-diameter portion; an opening to which the protrusion is fitted; and a receiving surface configured to contact the end face of the large-diameter portion from outward in an axial direction of the rotational shaft. At least one of the end face and the receiving surface includes a recessed portion.

5 Claims, 11 Drawing Sheets

PRINTING DEVICE INCLUDING HOLDER SUPPORTING PLATEN ROLLER THROUGH BEARINGS

CROSS REFERENCE TO RELATED APPLICATION

This application claims priority from Japanese Patent Application No. 2016-185034 filed Sep. 23, 2016. The entire content of the priority application is incorporated herein by reference.

TECHNICAL FIELD

The present disclosure relates to a printing device.

BACKGROUND

Portable printing devices are well known in the art. Japanese Patent application Publication No. 2015-160427 describes an example of one such printing device provided with a belt clip. By attaching the printing device to a waist belt with this belt clip, the user can use the printing device portably. To this printing device, a structure disclosed in Japanese Patent application Publication No. 2015-208920 may be applicable. The printing device described in Japanese Patent application Publication No. 2015-208920 includes a rear cover rotatably supported to be opened and closed. The rear cover is provided with support cylinders (corresponding to bearings) that rotatably support both ends of a rotational shaft of a platen roller. The support cylinders may be presumably fitted with a holder, and the holder may be fixed to the rear cover with screws.

SUMMARY

A user may accidentally drop the portable printing device when attaching the device to or detaching the device from a belt. In such an event, the impact from the fall may exert a force on the platen roller in the axial direction of the rotational shaft, causing the support cylinders to collide with the holder. Depending on the height from which the printing device is dropped, the holder could be damaged as a result of the collision between the support cylinders and the holder.

In view of the foregoing, it is an object of the present disclosure to provide a printing device capable of preventing damage to a holder supporting bearings caused by an impact incurred when the printing device is dropped.

In order to attain the above and other objects, the disclosure provides a printing device including a platen roller, a pair of bearings and a holder supporting the platen roller. The platen roller has a rotational shaft defining an axis extending in an axial direction. The rotational shaft has end portions in the axial direction. The pair of bearings rotatably supports the respective end portions of the rotational shaft. Each of the bearings includes: a small-diameter portion having a generally cylindrical shape; a large-diameter portion having a generally cylindrical shape; and a protrusion provided at an outer circumferential surface of the small-diameter portion. The large-diameter portion has a diameter larger than a diameter of the small-diameter portion and is coaxially connected to the small-diameter portion. The larger-diameter portion has a peripheral surface and an end face connecting the peripheral surface to the outer circumferential surface of the small-diameter portion. The holder includes a pair of fitting portions. The pair of bearings is respectively fitted to the pair of fitting portions. Each of the fitting portions includes a receiving portion, an opening, and a receiving surface. The receiving portion is configured to receive the small-diameter portion of the corresponding bearing. The receiving portion has a generally C-shape when viewed in the axial direction and has a pair of distal end portions opposing each other to define a gap therebetween. The receiving portion is configured to contact the outer circumferential surface of the small-diameter portion. The opening is the gap defined between the pair of distal end portions of the receiving portion. The protrusion of the corresponding bearing is fitted to the opening to prevent the bearing from rotating relative to the receiving portion. The receiving surface is configured to make contact with the end face of the large-diameter portion of the corresponding bearing from outward in the axial direction. At least one of the end face and the receiving surface includes a recessed portion.

BRIEF DESCRIPTION OF THE DRAWINGS

The particular features and advantages of the disclosure as well as other objects will become apparent from the following description taken in connection with the accompanying drawings, in which.

DETAILED DESCRIPTION

[Printing Device 1]

Next, a printing device 1 according to an embodiment of the present disclosure will be described while referring to the accompanying drawings.

The printing device 1 is a thermal printing device that can print on a heat-sensitive printing medium (thermal paper).

The printing device 1 may be battery-powered. The printing device 1 may be attached to the user's belt with a belt clip (not shown), for example, enabling the user to carry the printing device 1 while working. The printing device 1 can be connected to an external device (not shown) using a USB (registered trademark) cable. The printing device 1 can print text, illustrations, and the like on a printing medium based on print data received from the external device. The external device may be a common personal computer (PC), for example.

In the following description, the lower-right side, upper-left side, upper-right side, lower-left side, top, and bottom of the printing device 1 in FIG. 1 will be respectively defined as the right side, left side, rear side, front side, top, and bottom of the printing device 1.

Figure 1:
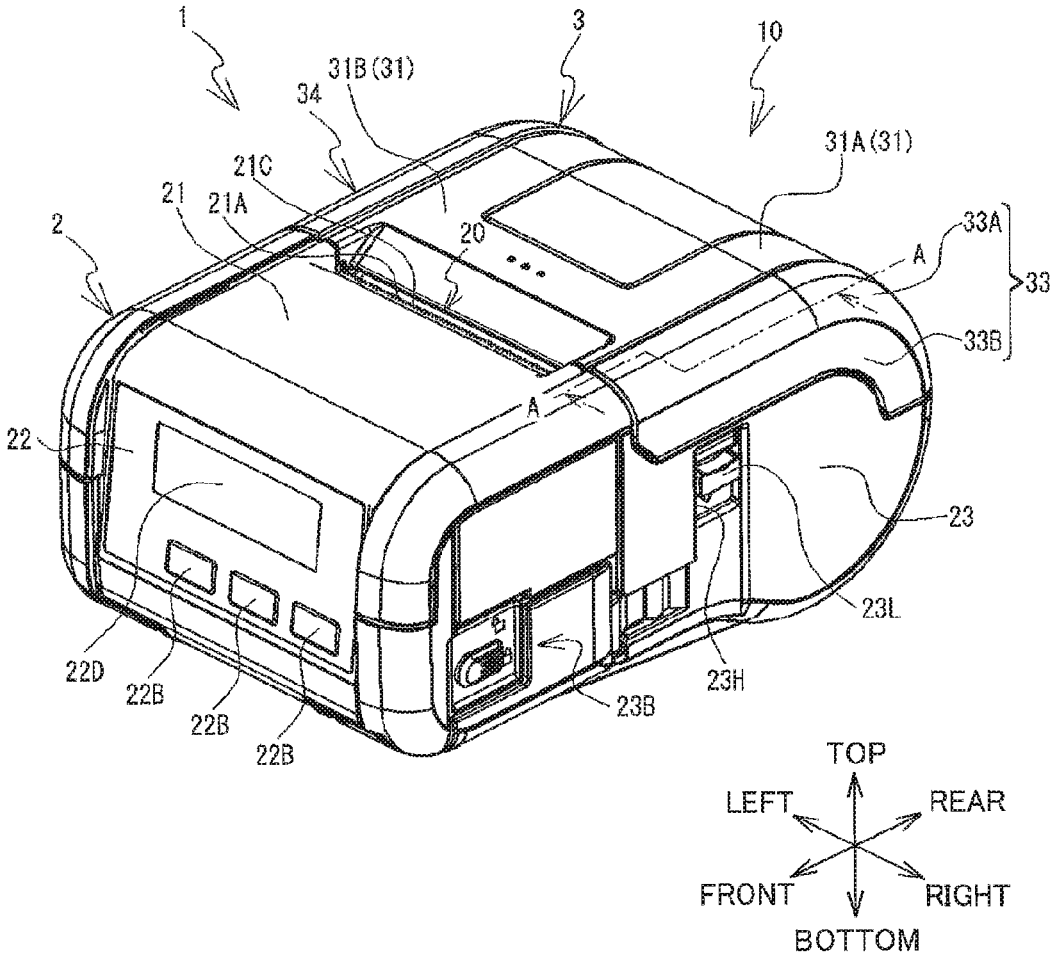
FIG. 1 is a perspective view of a printing device according to an embodiment and illustrates a state where a second cover is at its closed position.
Figure 2:
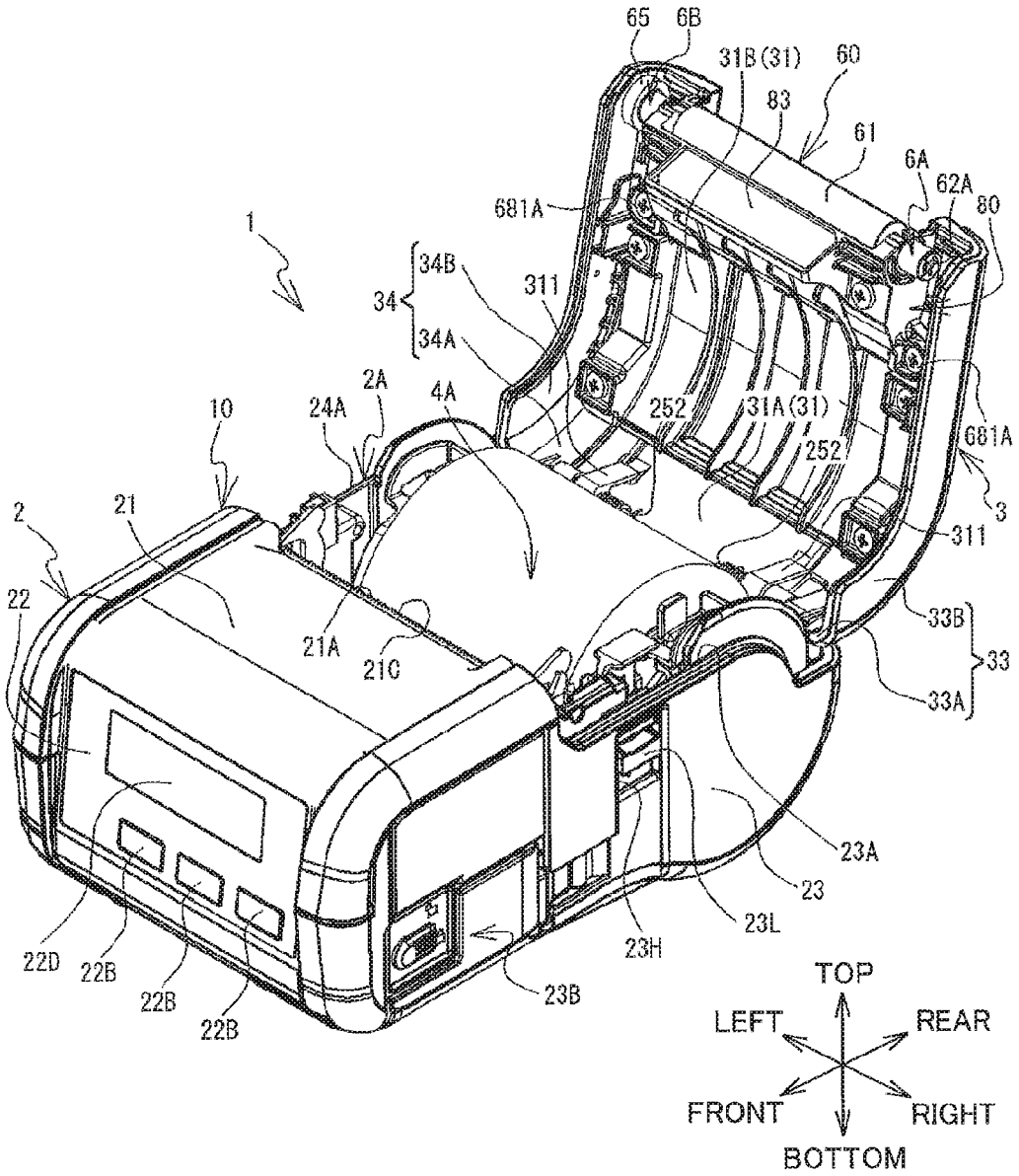
FIG. 2 is a perspective view of the printing device according to the embodiment and illustrates a state where the second cover is at its open position.
Figure 3:
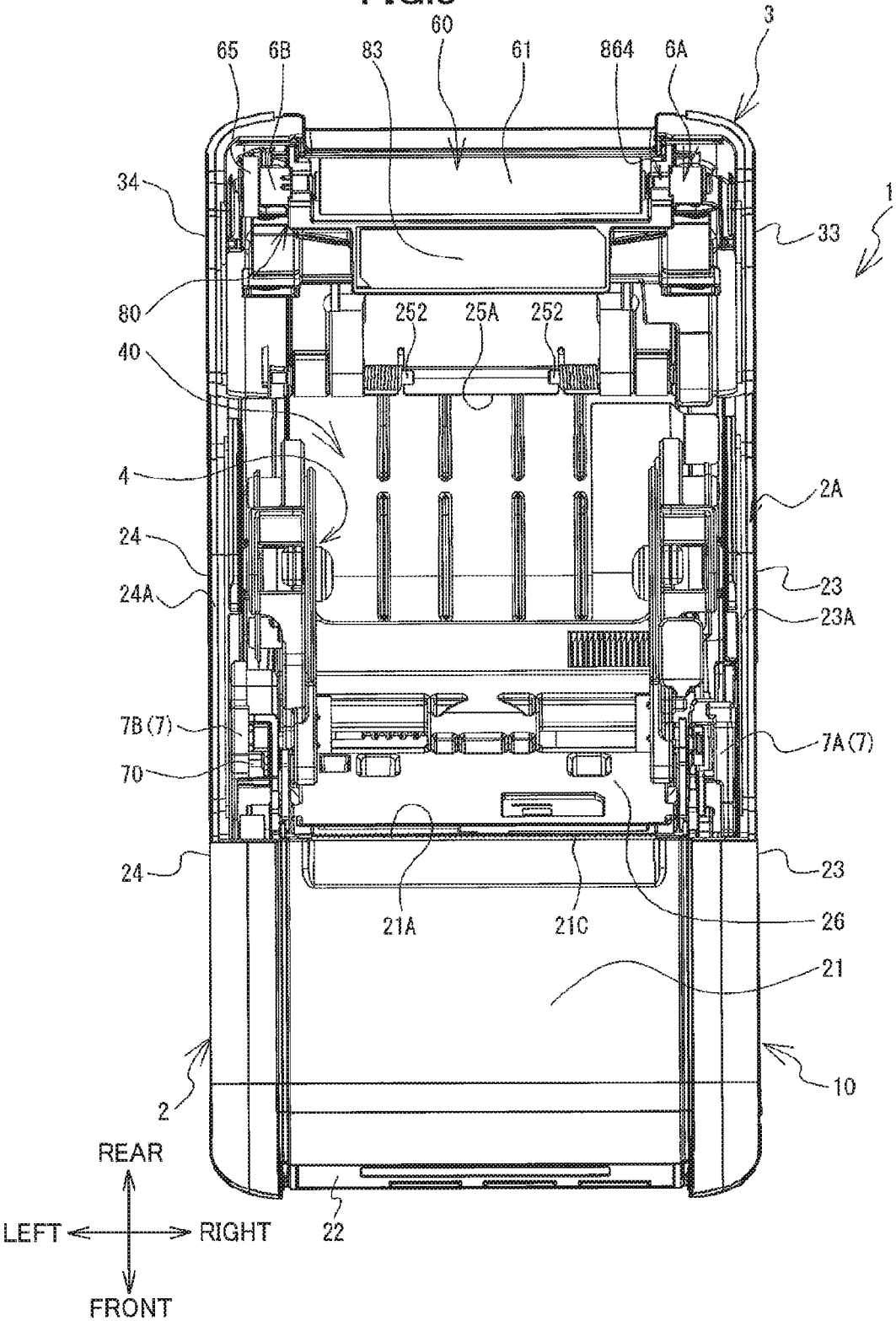
FIG. 3 is a plan view of the printing device according to the embodiment and illustrates a state where the second cover is at its closed position.

As shown in FIGS. 1 through 3, the printing device 1 includes a housing 10. The housing 10 has a general box-like rectangular parallelepiped shape that is elongated in a front-rear direction. The housing 10 includes a first cover 2 and a second cover 3.

<First Cover 2>

The first cover 2 is configured in a box-like shape. The first cover 2 includes a front wall portion 22, a right wall portion 23, a left wall portion 24, a rear wall portion 25 (see FIG. 4), a bottom wall portion 26 (see FIG. 5) and a top wall portion 21. The top wall portion 21 constitutes a frontward portion of a top wall of the housing 10, that is, a portion that is positioned frontward relative to an approximate front-rear center of the top wall of the housing 10.

As shown in FIGS. 1 and 2, a display 22D and switches 22B are provided on the front wall portion 22. The display 22D can display characters to be printed on the printing medium, setting information, and the like. The switches 22B enable the user to input commands for various operations performed on the printing device 1. The right wall portion 23 is formed with a lever hole 23H and a battery retaining portion 23B formed therein. The lever hole 23H is a rectangular through-hole that is elongated vertically. A lever 23L protrudes rightward from the lever hole 23H. The lever 23L can move vertically within the lever hole 23H. The lever 23L is configured to switch locking and unlocking of the second cover 3 described later. The battery retaining portion 23B is shaped to accommodate a battery used to power the printing device 1 and functions to retain the battery inserted therein.

Figure 4:
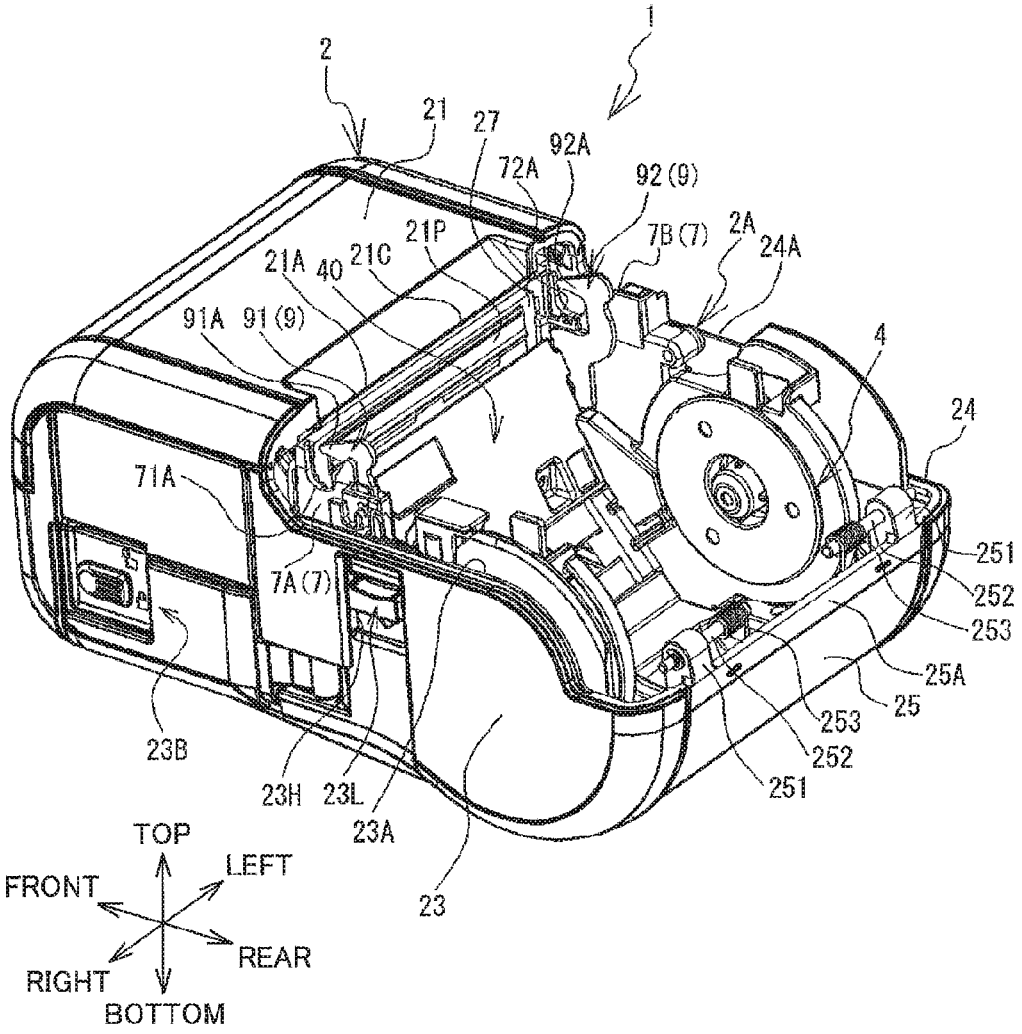
FIG. 4 is a perspective view of the printing device according to the embodiment and illustrates a state where the second cover at its closed position is omitted.

A main chassis (not shown) is provided beneath a rear edge portion 21A of the top wall portion 21. The main chassis supports a motor and the like (not shown). The main chassis also supports the lever 23L so as to allow the lever 23L to move up and down. As shown in FIG. 4, the main chassis includes an inner wall portion 27 that extends downward beneath the rear edge portion 21A of the top wall portion 21. The inner wall portion 27 includes a cutter 21C that extends along the bottom of the rear edge portion 21A. The cutter 21C is a blade that is configured to cut off a portion of a printing medium that has been printed. A thermal head 21P is disposed below the cutter 21C. The thermal head 21P is configured to print characters and the like by applying heat to the printing medium. The cutter 21C and thermal head 21P are elongated in a left-right direction.

The main chassis also includes a pair of support portions 7. Specifically, the support portions 7 include a support portion 7A and a support portion 7B. The support portion 7A extends rearward from a right edge of the inner wall portion 27. The support portion 7B extends rearward from a left edge of the inner wall portion 27. The support portion 7 supports a restricting mechanism 9 described later. The support portion 7 will be described later in greater detail. As shown in FIG. 3, a gear 70 is rotatably supported by the main chassis at a position frontward of the support portion 7B. The gear 70 is a spur gear whose rotational axis is aligned in the left-right direction. The gear 70 is rotatable by the drive of the motor supported on the main chassis.

As shown in FIG. 4, a rear portion of a top edge on the right wall portion 23 that is positioned rearward of the top wall portion 21 will be called an "edge portion 23A." The edge portion 23A extends linearly rearward from a right end of the rear edge portion 21A of the top wall portion 21 and then curves to extend downward. Likewise, a rear portion of a top edge on the left wall portion 24 that is positioned rearward of the top wall portion 21 will be called an "edge portion 24A." The edge portion 23A and the edge portion 24A have the same shape as each other.

Further, as also shown in FIG. 4, a top edge of the rear wall portion 25 will be called an "edge portion 25A." The edge portion 25A extends linearly in the left-right direction to span between rear ends of the edge portions 23A and 24A. Two support portions 251 are disposed at the rear wall portion 25 to protrude upward relative to the edge portion 25A. Specifically, one of the support portions 251 protrudes upward from the edge portion 25A near a right end thereof, while the other support portion 251 protrudes upward from the edge portion 25A near a left end thereof. Each support portion 251 supports a shaft 252 that is oriented in the left-right direction. Each shaft 252 extends inward from the corresponding support portion 251. A spring 253 is mounted over each of the shafts 252.

As shown in FIG. 3, an area surrounded by the edge portions 21A, 23A, 24A, and 25A is defined as an open area 2A having a general rectangular shape in a top view. That is, the open area 2A is formed in an upper portion of the first cover 2 from an approximate front-rear center thereof to a rear edge of the same. The open area 2A opens into a compartment 40 in the first cover 2. The compartment 40 is formed in the interior of the housing 10 to extend from an approximate center thereof to a rear end thereof in the front-rear direction. The compartment 40 is a space surrounded by the inner wall portion 27, the right wall portion 23, the left wall portion 24, the rear wall portion 25, and the bottom wall portion 26. As shown in FIG. 4, a roll holder 4 is accommodated and fixed in the compartment 40. The roll holder 4 rotatably retains a roll 4A (see FIG. 2). The roll 4A is a roll of printing media. Both left and right ends of the roll 4A are rotatably supported by the roll holder 4.

<Restricting Mechanism 9>

The restricting mechanism 9 includes a pair of plate-shaped restricting members 91 and 92, and a connecting member (not shown). The restricting member 91 is disposed near the right edge of the inner wall portion 27, while the restricting member 92 is disposed near the left edge of the inner wall portion 27. The restricting members 91 and 92 are spaced apart from each other in the left-right direction. That is, side surfaces of the restricting members 91 and 92 face rightward or leftward. A protruding portion 91A is disposed on a top end of the restricting member 91 and protrudes forward therefrom. A protruding portion 92A is disposed on a top end of the restricting member 92 and protrudes forward therefrom. Respective upper end portions of the protruding portions 91A and 92A slope downward toward the front side. The restricting members 91 and 92 are connected to each other with a coupling portion (not shown) provided at respective bottom ends of the restricting members 91 and 92.

Figure 5:
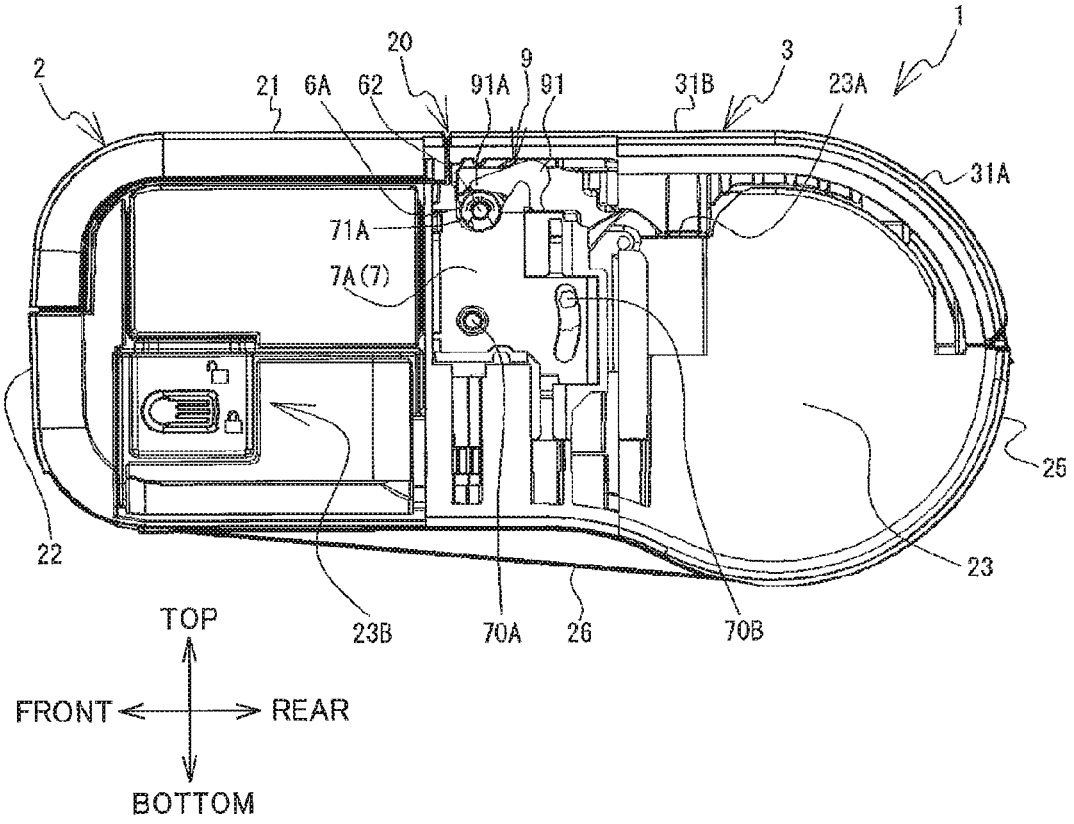
FIG. 5 is a cross-sectional view taken along a line A-A in FIG. 1 as viewed in a direction shown in by an arrow.

As shown in FIG. 5, the support portion 7A has a shaft 70A oriented in the left-right direction. The connecting member and the bottom end of the restricting member 91 are rotatably supported on the shaft 70A. The connecting member is disposed between the restricting member 91 and the lever 23L (see FIG. 1) in the left-right direction. The connecting member includes a shaft 70B that protrudes in the left-right direction. A portion of the shaft 70B that protrudes leftward relative to the connecting member is inserted into a hole (not shown) formed in the rear end of the restricting member 91. A portion of the shaft 70B that protrudes rightward relative to the connecting member is inserted into a recessed part (not shown) formed in the lever 23L. With this configuration, the connecting member connects the lever 23L to the restricting member 91. The shaft 70B moves vertically in response to an operation of the lever 23L. When the shaft 70B moves vertically, the restricting member 91 pivots about the shaft 70A. Note that the restricting member 92 also pivots in the same directions as the restricting member 91 in response to pivoting of the restricting member 91. A spring (not shown) provided on the connecting member urges the restricting members 91 and 92 counterclockwise in a right side view.

In the following description, unless otherwise specified, a pivoting direction (clockwise or counterclockwise) is denoted as a pivoting direction of a member as viewed from a right side thereof. Also, hereinafter, a state in which the restricting members 91 and 92 are pivoted counterclockwise by the urging force of the spring (shown in FIGS. 4 and 5) will be called a "restricting state". A state in which the restricting members 91 and 92 are pivoted clockwise against the urging force of the spring will be called a "non-restricting state."

When the lever 23L moves upward, the restricting members 91 and 92 pivot counterclockwise, and the protruding portions 91A and 92A move forward. When the lever 23L has moved to its uppermost position, the restricting members 91 and 92 are in the restricting state. In the restricting state, the protruding portion 91A is disposed above a recessed portion 71A formed in an upper edge of the support portion 7A and the protruding portion 92A is disposed above a recessed portion 72A formed in an upper edge of the support portion 7B, as shown in FIG. 4. When the lever 23L moves downward, the restricting members 91 and 92 pivot clockwise, and the protruding portions 91A and 92A move rearward. When the lever 23L has moved to its lowermost position, the restricting members 91 and 92 are in the non-restricting state. At this time, the protruding portion 91A is disposed rearward of the recessed portion 71A formed in the support portion 7A and the protruding portion 92A is disposed rearward of the recessed portion 72A formed in the support portion 7B.

<Second Cover 3>

As illustrated in FIGS. 1 and 2, the second cover 3 is pivotably movable between a closed position covering the top of the open area 2A (illustrated in FIG. 1) and an open position exposing the open area 2A (illustrated in FIG. 2). In the following description, directions relating to the printing device 1 will also be applied to the second cover 3, under an assumption that the second cover 3 is in the closed position. The second cover 3 constitutes a rearward portion of the top wall of the housing 10, that is, a portion positioned rearward of the approximate front-rear center of the same.

As shown in FIGS. 1 and 2, the second cover 3 includes a cover plate portion 31, and side plate portions 33 and 34. The cover plate portion 31 has a first portion 31A and a second portion 31B. The first portion 31A has a curved plate shape, while the second portion 31B has a flat plate shape. The first portion 31A has protruding portions 311 formed on a rear edge of the first portion 31A. Each protruding portion 311 includes a hole in which each of the two shafts 252 of the first cover 2 (see FIG. 4) is inserted. The second portion 31B extends frontward from a front edge of the first portion 31A.

The side plate portion 33 is connected to a right edge of the cover plate portion 31. The side plate portion 33 has a first portion 33A and a second portion 33B. The first portion 33A curves while extending downward from the right edge of the cover plate portion 31. The second portion 33B extends from a bottom edge of the first portion 33A downward, i.e., in a direction orthogonal to the cover plate portion 31. The side plate portion 34 is connected to a left edge of the cover plate portion 31. The side plate portion 34 has a first portion 34A and a second portion 34B. The first portion 34A curves while extending downward from the left edge of the cover plate portion 31. The second portion 34B extends from a bottom edge of the first portion 34A downward, i.e., in a direction orthogonal to the cover plate portion 31.

<Holder 80>

A holder 80 is disposed at an inner wall of the second portion 31B near a front edge thereof. The holder 80 is configured to rotatably support a platen roller 60.

Figure 6:
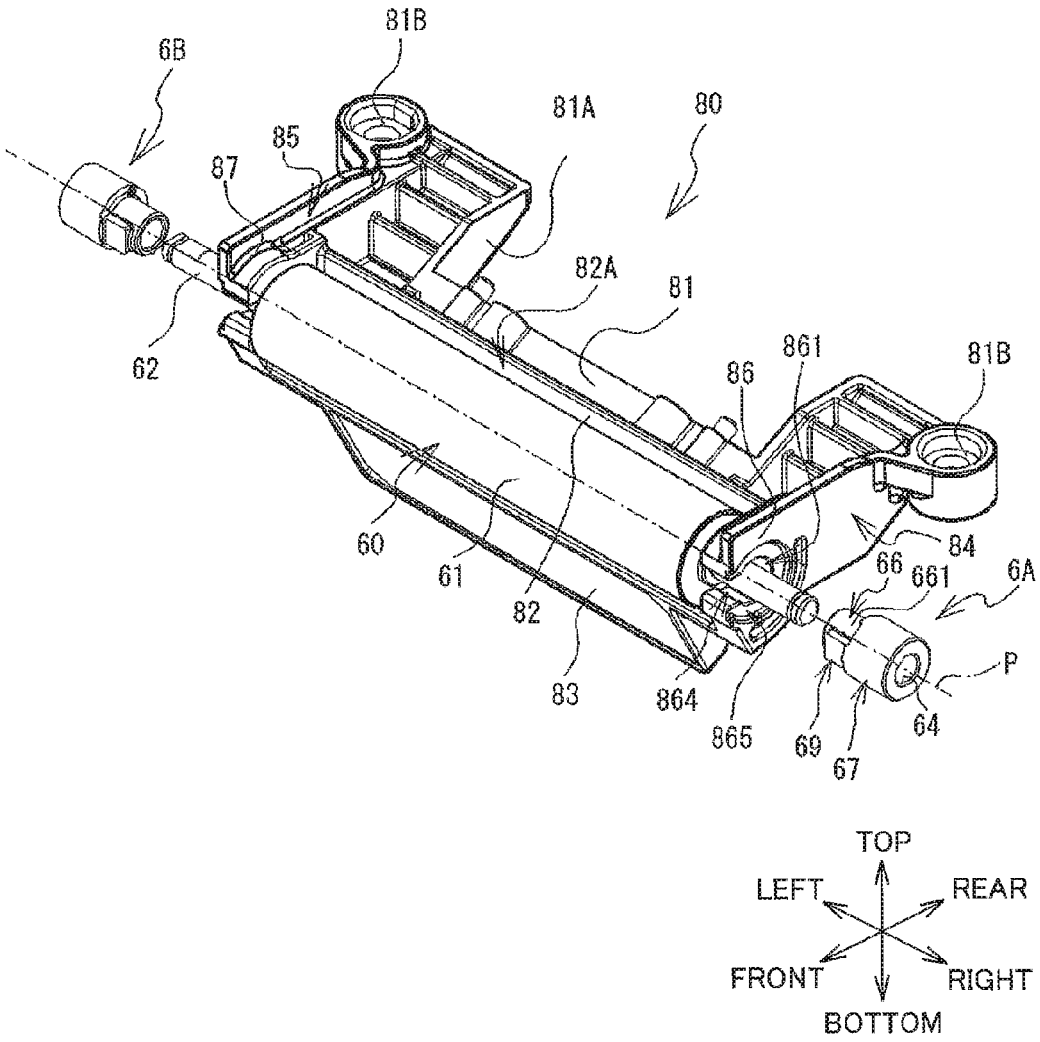
FIG. 6 is an exploded perspective view of a platen roller, a holder and right and left bearings in the printing device according to the embodiment.

As shown in FIG. 6, the holder 80 has a symmetrical shape with respect to the left-right direction. The holder 80 includes a first portion 81, a second portion 82, a third portion 83, a right wall portion 84, and a left wall portion 85. The first portion 81 constitutes a rear portion of the holder 80. The first portion 81 has a general rectangular shape elongated in the left-right direction in a top view. In a side view, the first portion 81 is sloped to extend upward toward the rear. A recessed portion 81A is formed in a left-right center of a rear end portion of the first portion 81 to be recessed forward therefrom. A through-hole 81B is formed in each of left and right ends of the rear end portion of the first portion 81. The through-holes 81B vertically penetrate the left and right ends of the rear end portion of the first portion 81, respectively.

The second portion 82 constitutes a front portion of the holder 80. The second portion 82 curves downward and rearward in conformance with a shape of a platen 61 described later. With this shape of the second portion 82, a platen accommodating portion 82A is provided at a front side of the second portion 82. The platen accommodating portion 82A is a space for accommodating the platen 61 therein. The platen accommodating portion 82A extends to span between a right end and a left end of the second portion 82. The front edge of the first portion 81 is connected to a bottom edge of the second portion 82 on the rear side thereof.

The third portion 83 constitutes a bottom portion of the holder 80. The third portion 83 has a general rectangular shape in a front view and is elongated in the left-right direction. An upper edge of the third portion 83 is connected to the bottom of the second portion 82. The third portion 83 has a front surface that occupies a plane sloping to extend rearward toward the bottom.

The right wall portion 84 is connected to the right ends of the first portion 81 and second portion 82. The right wall portion 84 has a general rectangular shape in a right side view and is elongated in the front-rear direction. The right wall portion 84 extends to the front side of the second portion 82. That is, a portion of the right wall portion 84 is positioned to cover the platen accommodating portion 82A from rightward thereof. In the following description, the portion of the right wall portion 84 that covers the right end of the platen accommodating portion 82A (i.e., a front end portion of the right wall portion 84) will be called a "fitting portion 86."

Likewise, the left wall portion 85 has a general rectangular shape in a left side view and is elongated in the front-rear direction. The left wall portion 85 extends to the front side of the second portion 82. That is, a portion of the left wall portion 85 is positioned to cover the platen accommodating portion 82A from leftward thereof. In the following description, the portion of the left wall portion 85 that covers the left end of the platen accommodating portion 82A (i.e., a front end portion of the left wall portion 85) will be called a "fitting portion 87."

<Fitting Portions 86 and 87>

Figure 7:
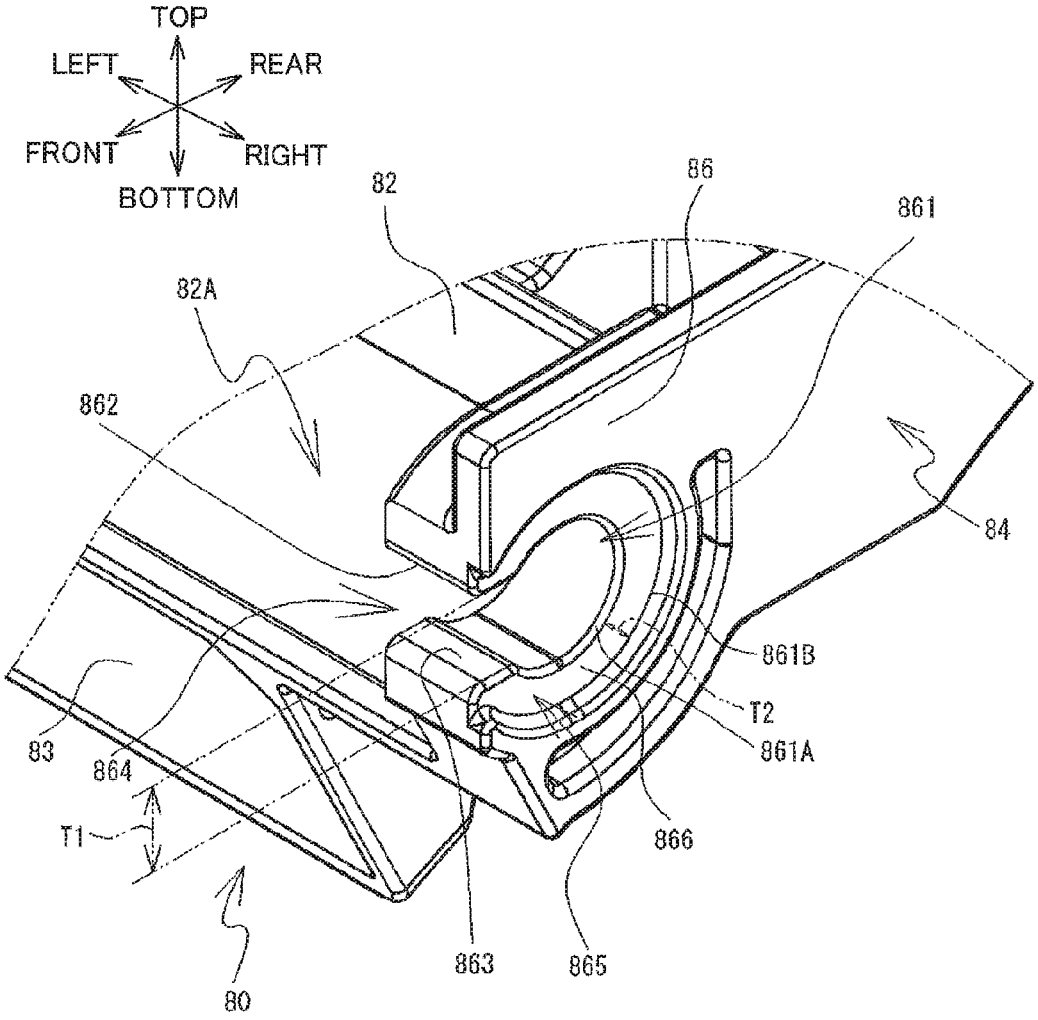
FIG. 7 is a partially-enlarged perspective view of a fitting portion of the holder of the printing device according to the embodiment and in the vicinity thereof.

The fitting portions 86 and 87 oppose each other in the left-right direction. Since the fitting portions 86 and 87 have symmetrical shapes as each other with respect to the left-right direction, only the fitting portion 86 will be described here, while a description for the fitting portion 87 will be omitted. As shown in FIG. 7, the fitting portion 86 includes a receiving portion 861 that is recessed rearward. The receiving portion 861 is a wall having a prescribed length in the left-right direction. The receiving portion 861 has a C-shape in a right side view. The receiving portion 861 includes distal end portions 862 and 863 that oppose each other in a vertical direction with a gap defined therebetween. Specifically, the distal end portions 862 and 863 of the receiving portion 86 are spaced apart from each other in the vertical direction by a distance T1. The distal end portion 862 is positioned above the distal end portion 863. In the following description, the gap defined between the distal end portions 862 and 863 of the receiving portion 861 will be called an "opening 864."

A recessed portion 865 is formed in a right surface of the fitting portion 86 to be recessed leftward therefrom along a peripheral edge of the receiving portion 861. In the following description, a bottom surface of the recessed portion 865 will be called a "receiving surface 866." That is, the receiving surface 866 is a flat surface occupying a plane orthogonal to the left-right direction. The receiving surface 866 has a C-shape in a right side view. An inner edge portion of the recessed portion 865 defining an inner edge of the receiving surface 866 (i.e., an inner peripheral edge of the receiving portion 861) will be called an "inner edge portion 861A." An outer edge portion of the recessed portion 865 defining an outer edge of the receiving surface 866 will be called an "outer edge portion 861B." The receiving surface 866 has a dimension T2 in a radial direction thereof between the inner edge portion 861A and the outer edge portion 861B.

<Platen Roller 60>

As illustrated in FIG. 6, the platen roller 60 includes the platen 61, and a rotational shaft 62. The platen 61 has a left-right dimension that is slightly shorter than the distance between the fitting portions 86 and 87. The platen 61 is disposed in the platen accommodating portion 82A (i.e., between the fitting portions 86 and 87). The platen 61 is a cylindrically shaped member that is elongated in the left-right direction. The platen 61 has a through-hole (not shown) formed therein to penetrate a radial center of the platen 61 in the left-right direction. The rotational shaft 62 is a columnar-shaped shaft member oriented in the left-right direction. The rotational shaft 62 penetrates the through-hole formed in the platen 61. Left and right end portions of the rotational shaft 62 protrude outward from left and right ends of the platen 61, respectively. The platen 61 is fixed to the rotational shaft 62 so as to be rotatable together with the rotational shaft 62.

<Bearings 6A and 6B>

Bearings 6A and 6B are provided respectively on left and right ends of the rotational shaft 62 constituting the platen roller 60. The bearing 6A is disposed on the right end portion of the rotational shaft 62 that protrudes rightward from the platen 61, while the bearing 6B is disposed on the left end portion of the rotational shaft 62 that protrudes leftward from the platen 61. Since the bearings 6A and 6B have left-right symmetrical shapes as each other, a description will be given on the bearing 6A only, while a description for the bearing 6B will be omitted.

The bearing 6A is a generally cylindrical shaped member having a through-hole 64 in which the rotational shaft 62 is inserted. The through-hole 64 extends in the left-right direction along a center axis P of the bearing 6A. The bearing 6A has a left-right dimension that is smaller than a left-right length of the right end portion of the rotational shaft 62 protruding rightward from the right end of the platen 61.

Figure 8:
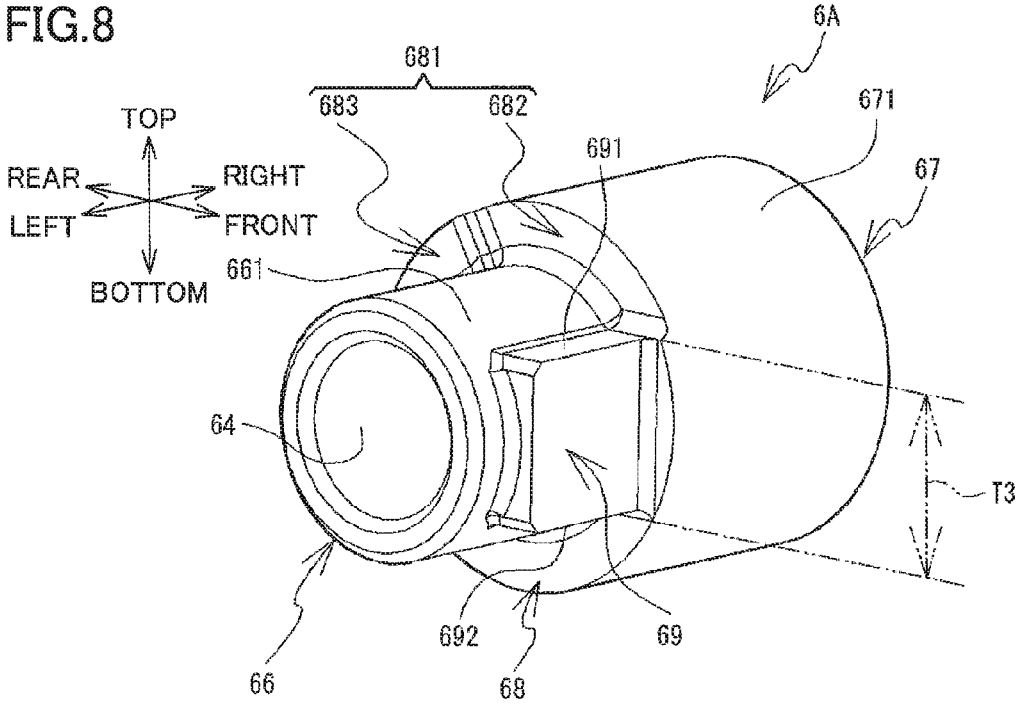
FIG. 8 is a perspective view of the right bearing of the printing device according to the embodiment.

More specifically, referring to FIG. 8, the bearing 6A includes a small-diameter portion 66, and a large-diameter portion 67. The small-diameter portion 66 has a cylindrical shape and constitutes a leftward portion of the bearing 6A. The small-diameter portion 66 has an outer diameter that is substantially equivalent to an inner diameter of the receiving portion 861. The large-diameter portion 67 has a cylindrical shape and constitutes a rightward portion of the bearing 6A. The large-diameter portion 67 has an outer diameter that is larger than the outer diameter of the small-diameter portion 66 and, hence, larger than the inner diameter of the receiving portion 861. The large-diameter portion 67 is coaxially connected to a right surface of the small-diameter portion 66. As a result, a stepped structure is formed between the small-diameter portion 66 and the large-diameter portion 67.

Figure 9:
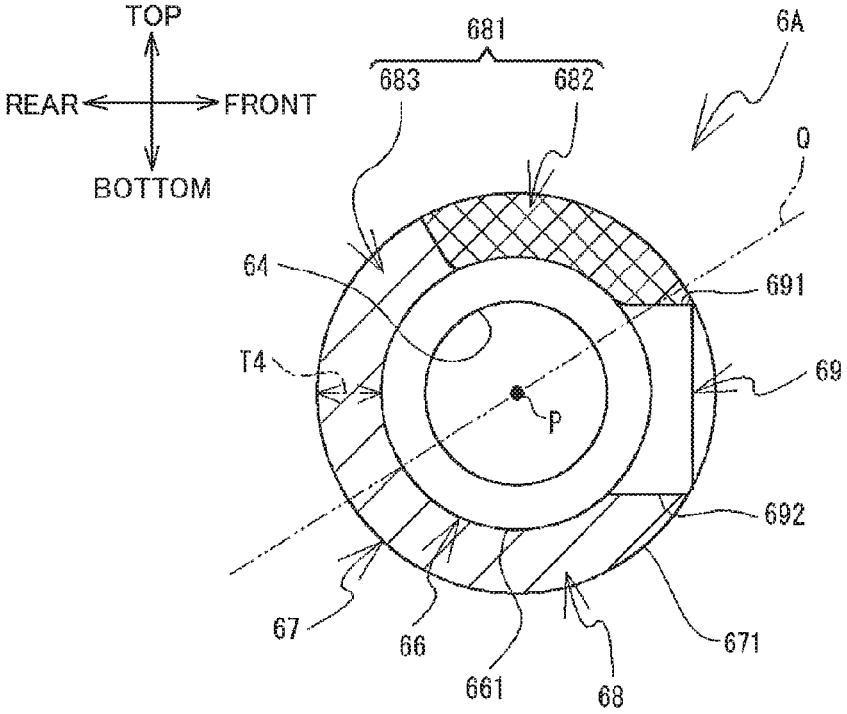
FIG. 9 is a left side view of the right bearing of the printing device according to the embodiment.

Hereinafter, the stepped structure between the small-diameter portion 66 and large-diameter portion 67 includes an end face 68. More specifically, the end face 68 constitutes a left end of the large-diameter portion 67 and connects an outer circumferential surface 661 of the small-diameter portion 66 and a peripheral surface 671 of the large-diameter portion 67. The end face 68 is orthogonal to the direction in which the through-hole 64 extends (i.e., the left-right direction). The end face 68 has a ring-like shape in a left side view. The end face 68 extends in a circumferential direction of the large-diameter portion 67, in a left side view, as shown in FIG. 9.

On the outer circumferential surface 661 of the small-diameter portion 66, a protrusion 69 is provided. Referring to FIG. 9, in the embodiment, the protrusion 69 extends along a circumference of the outer circumferential surface 661 to occupy approximately one-fourth thereof. The protrusion 69 has a generally rectangular parallelepiped shape in a front view. The protrusion 69 also extends in the left-right direction from a position on the outer circumferential surface 661 near a left edge thereof, to the end face 68. That is, the protrusion 69 occupies a portion of the end face 68 in the circumferential direction of the large-diameter portion 67. The protrusion 69 has a left-right dimension that is approximately equal to the left-right dimension of the receiving portion 861 (see FIG. 7). The protrusion 69 has a top surface 691 and a bottom surface 692. The protrusion 69 has a vertical dimension T3 (distance between the top surface 691 and bottom surface 692) that is smaller than the outer diameter of the small-diameter portion 66 and that is approximately equal to the distance T1 between the distal end portions 862 and 863 of the receiving portion 861 (see FIG. 7).

Hereinafter, a portion of the end face 68 other than the portion occupied by the protrusion 69 will be referred to as a specific surface 681. That is, referring to FIG. 9, the specific surface 681 extends, in the circumferential direction of the large-diameter portion 67, counterclockwise from the top surface 691 of the protrusion 69 until the bottom surface 692 of the protrusion 69 in a left side view. The specific surface 681 has a radial dimension T4 in a left side view that is slightly smaller than the dimension T2 of the receiving surface 866.

The specific surface 681 includes a recessed portion 682 and a contact surface 683. The recessed portion 682 is a portion of the specific surface 681 that is recessed rightward relative to the contact surface 683. The recessed portion 682 has a bottom surface extending parallel to the contact surface 683. The recessed portion 682 extends from a right edge on the top surface 691 of the protrusion 69. The recessed portion 682 extends a prescribed length in a counterclockwise direction, in a left side view, from the top surface 691 of the protrusion 69 (more specifically, from a right edge on the top surface 691). A portion of the specific surface 681 other than the recessed portion 682 is the contact surface 683. The contact surface 683 extends from a downstream end of the recessed portion 682 in the counterclockwise direction to the bottom surface 692 (more specifically, a right edge on the bottom surface 692) of the protrusion 69 in a left side view. In the embodiment, the recessed portion 682 has an area that is equivalent to approximately one-half of an area of the contact surface 683. In other words, the recessed portion 682 constitutes approximately one-third of an entire area of the specific surface 681 (the area of the recessed portion 682+the area of the contact surface 683). In FIG. 9, the recessed portion 682 is depicted with cross-hatching, while the contact surface 683 is depicted with oblique lines.

<Assembly and Operations of the Platen Roller 60, Bearings 6A and 6B, and Holder 80>

As illustrated in FIG. 6, the platen roller 60 is assembled to the holder 80 from a front side thereof. The platen 61 is disposed in the platen accommodating portion 82A (i.e., between the pair of fitting portions 86 and 87). The right end of the rotational shaft 62 is inserted through the opening 864 formed in the fitting portion 86 and disposed within the receiving portion 861 of the fitting portion 86 so as to protrude rightward therefrom. Similarly, the left end of the rotational shaft 62 is inserted through the corresponding opening formed in the fitting portion 87 and disposed within the corresponding receiving portion of the fitting portion 87 so as to protrude leftward therefrom.

Figure 10:
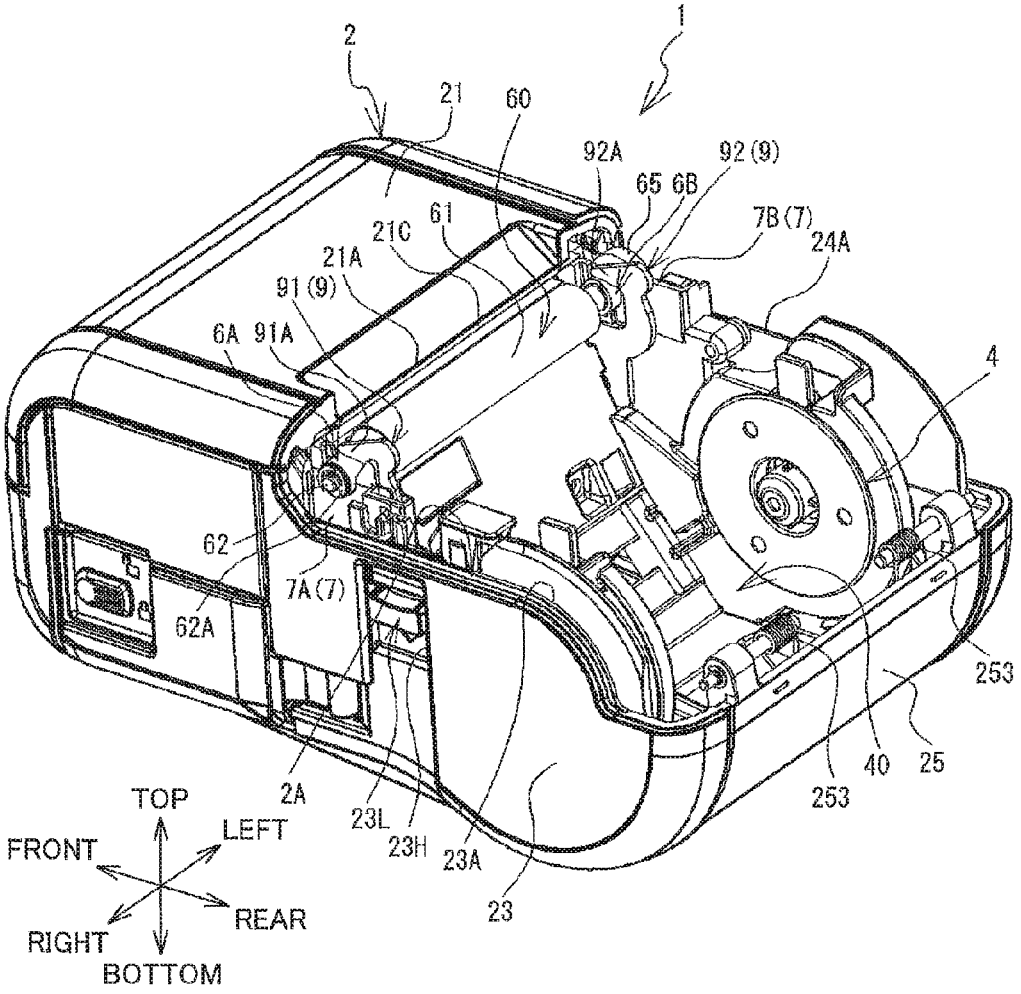
FIG. 10 is a perspective view of the printing device according to the embodiment and illustrating the platen roller and the right and left bearings in a state where the second cover at its closed position is omitted.

With the platen roller 60 disposed in the holder 80, the bearing 6A is assembled on the right end of the rotational shaft 62 from the right side thereof. That is, the right end of the rotational shaft 62 is inserted into the through-hole 64 of the bearing 6A from leftward thereof. The rotational shaft 62 is rotatable relative to the bearing 6A. The outer circumferential surface 661 of the small-diameter portion 66 excluding the protrusion 69 is fitted into the receiving portion 861, while the protrusion 69 is fitted into the opening 864 of the fitting portion 86. Since the vertical dimension T3 of the protrusion 69 is approximately equal to the distance T1 between the distal end portions 862 and 863 of the receiving portion 861, the distal end portion 862 contacts the top surface 691 of the protrusion 69, while the distal end portion 863 contacts the bottom surface 692 of the protrusion 69. With this structure, the protrusion 69 is restricted from rotating about the rotational shaft 62, thereby providing positioning of the recessed portion 682 relative to the receiving surface 866. In the embodiment, the recessed portion 682 is arranged to oppose a region on the receiving surface 866 in the left-right direction, the region being from the distal end portion 862 to an area upward of the rotational shaft 62. As shown in FIGS. 2 and 10, a snap ring 62A is clamped on the rotational shaft 62 on the right side of the bearing 6A. The snap ring 62A prevents the bearing 6A from coming off the rotational shaft 62. The bearing 6A is slightly movable in the left-right direction along the rotational shaft 62 between the snap ring 62A and the right end of the platen 61. In other words, the bearing 6A is mounted on the rotational shaft 62 with some play in the left-right direction.

The bearing 6B is similarly assembled on the left end of the rotational shaft 62 from the left side thereof. Since assembly of the bearing 6B differs from assembly of the bearing 6A only in that the left and right directions are reversed, this description has been omitted. A gear 65 is fixed on the left end of the rotational shaft 62 at a position leftward of the bearing 6B, as shown in FIGS. 3 and 10. The gear 65 is a spur gear. The gear 65 has an outer diameter that is larger than the outer diameter of the large-diameter portion 67 constituting the bearing 6B. By the gear 65 being fixed to the rotational shaft 62, the gear 65 prevents the bearing 6B from coming off the rotational shaft 62. The bearing 6B is slightly movable along the rotational shaft 62 in the left-right direction between the gear 65 and the left end of the platen 61. In other words, the bearing 6B is assembled to the rotational shaft 62 with some play in the left-right direction. With the bearings 6A and 6B fitted into the corresponding fitting portions 86 and 87, the left and right ends of the rotational shaft 62 of the platen roller 60 are rotatably supported by the bearings 6A and 6B.

Since the inner diameter of the receiving portion 861 is substantially equal to the outer diameter of the small-diameter portion 66, and since the radial dimension T4 of the specific surface 681 is smaller than the dimension T2 of the receiving surface 866, the contact surface 683 constituting the specific surface 681 of the bearing 6A contacts the receiving surface 866 of the fitting portion 86 from its right side in case that the bearing 6A moves leftward relative to the holder 80. In this way, the bearing 6A is restricted from moving farther leftward relative to the holder 80. However, the recessed portion 682 of the specific surface 681 does not make contact with the receiving surface 866, since a gap can be formed therebetween at this time. In this state, assume that the rotational shaft 62 is moved further leftward relative to the holder 80 and the bearing 6A. In this case, the snap ring 62A is brought into contact with the bearing 6A, which is restricted from moving leftward by the fitting portion 86. The rotational shaft 62 is thus restricted from moving further leftward relative to the holder 80 and bearing 6A. In this state, the left end of the platen 61 is not in contact with the right surface of the fitting portion 87.

In case that the bearing 6B moves rightward relative to the holder 80, the contact surface constituting the end region on the end face of the bearing 6B contacts the receiving surface of the fitting portion 87 from its left side. The bearing 6B is therefore restricted from moving further rightward relative to the holder 80. At this time, the recessed portion constituting the end region on the end face of the bearing 6B does not contact the receiving surface of the fitting portion 87, since a gap is formed therebetween. In this state, even assuming that the rotational shaft 62 is moved further rightward relative to the holder 80 and the bearing 6B, the gear 65 may contact the bearing 6B from the left side, thereby restricting the rotational shaft 62 from moving further rightward relative to the holder 80 and the bearing 6B. In this state, the right end of the platen 61 does not contact the left surface of the fitting portion 86. In this way, the left-right movement of the platen 61 relative to the holder 80 is restricted to within a prescribed range by the contact between the bearings 6A and 6B and the corresponding fitting portions 86 and 87.

In a state where the platen roller 60 and the bearings 6A and 6B assembled to the holder 80, a pair of screws 681A (see FIG. 2) is inserted into the corresponding through-holes 81B from below. The holder 80 is then screw-fixed to the second portion 31B of the second cover 3 with the screws 681A, with the platen roller 60 and bearings 6A and 6B assembled in the holder 80 (see FIG. 2).

<Opening and Closing Operations of the Second Cover 3>

As shown in FIG. 2, the second cover 3 is pivotably supported by the first cover 2 so as to be rotatable about the shafts 252 inserted into the holes formed in the protruding portions 311. The springs 253 mounted on the shafts 252 (see FIG. 4) urge the second cover 3 from the closed position (see FIG. 1) toward the open position (see FIG. 2). When the second cover 3 is pivoted counterclockwise against the urging force of the springs 253, the second cover 3 is moved into the closed position. In the closed position shown in FIG. 1, a front edge portion of the second portion 31B constituting the second cover 3 is positioned adjacent to the rear edge portion 21A of the first cover 2. A discharge opening 20 is formed between the rear edge portion 21A of the first cover 2 and the front edge portion of the second portion 31B. Printing media is configured to be discharged from the inside of the printing device 1 through the discharge opening 20 after being printed inside the printing device 1.

As illustrated in FIG. 10, the platen roller 60, which is supported by the second cover 3 through the holder 80, confronts the thermal head 21P provided on the inner wall portion 27 (see FIG. 4) when the second cover 3 is at the closed position. Specifically, when the second cover 3 is at the closed position, the platen 61 of the platen roller 60 is positioned adjacent to the rear side of the thermal head 21P. In a state where a printing medium is disposed between the platen 61 and thermal head 21P, the platen 61 is configured to press the printing medium against the thermal head 21P. The gear 65 of the second cover 3 is meshed with the gear 70 of the main chassis (see FIG. 3). As the gear 70 is rotated upon receipt of a drive force from the motor (not shown), the gear 65 and platen 61 are configured to rotate in association with rotation of the gear 70. At this time, the platen 61 is configured to convey the recording medium toward the discharge opening 20 while pressing the recording medium against the thermal head 21P.

As shown in FIG. 5, when the second cover 3 is at the closed position, the bearing 6A is received in and engaged with, from above, the recessed portion 71A formed in the support portion 7A. Since the restricting member 91 is in the restricting state, the protruding portion 91A of the restricting member 91 contacts the bearing 6A from above. Likewise, as shown in FIG. 10, the bearing 6B is received in and engaged with, from above, the recessed portion 72A formed in the support portion 7B (see FIG. 4). Since the restricting member 92 is in the restricting state, the protruding portion 92A contacts the bearing 6B from above. In this way, the restricting mechanism 9 is configured to restrict the platen roller 60 from moving upward. Accordingly, the restricting mechanism 9 can maintain the second cover 3 in the closed position and restrict the second cover 3 from pivoting toward the open position due to the urging force of the springs 253.

When the operator moves the lever 23L (see FIG. 1) downward while the second cover 3 is in the closed position, the restricting members 91 and 92 move to the non-restricting state from the restricting state. The protruding portion 91A of the restricting member 91 therefore moves to a position rearward of to the recessed portion 71A formed in the support portion 7A, and the protruding portion 92A of the restricting member 92 moves to a position rearward of the recessed portion 72A formed in the support portion 7B. Thus, the restricting mechanism 9 no longer restricts upward movement of the bearings 6A and 6B. Consequently, the urging force of the springs 253 causes the second cover 3 to pivot clockwise. As a result of the clockwise pivotal movement of the second cover 3, the second cover 3 is moved to the open position (see FIG. 2).

Operational and Technical Advantages of the Embodiment

In the holder 80 according to the embodiment, the second portion 82 is connected to the bottom and rear end portions of the fitting portion 86. That is, the bottom and rear end portions of the fitting portion 86 are structurally reinforced by the second portion 82. However, an upper portion of the fitting portion 86, particularly a portion near the distal end portion 862, is structurally weaker than the reinforced bottom and rear end portions of the fitting portion 86 (or, lower and rear end portions of the receiving surface 866), since the distal end portion 862 extends further forward relative to the second portion 82. That is, in the receiving portion 861, the distal end portion 862 is structurally weaker than a base portion of the receiving portion 861 (i.e., a portion other than the distal end portion 862).

In the embodiment, the recessed portion 682 of the specific surface 681 can provide a gap between the specific surface 681 and the receiving surface 866 of the holder 80 when the specific surface 681 and the receiving surface 866 oppose each other in the left-right direction. Thus, the specific surface 681 does not make contact with the receiving surface 866 at a region in which the recessed portion 682 is provided. Further, the protrusion 69 of the bearing 6A is fitted into the opening 864 of the fitting portion 86 so that the bearing 6A is restricted from rotating relative to the fitting portion 86. The position of the recessed portion 682 is thus fixed relative to the receiving surface 866.

With this structure, the contact surface 683 of the bearing 6A is allowed to face and contact a portion of the holder 80 that is relatively strong in structure (i.e., lower and rear end portions of the receiving surface 866) in the left-right direction, while the recessed portion 682 of the bearing 6A is arranged to oppose the distal end portion 862 (a portion of the holder 80 that is not structurally strong) in the left-right direction. Thus, even if the printing device 1 is dropped and the impact from the fall exerts a force in the axial direction of the rotational shaft 62 of the platen roller 60 (i.e., the left-right direction), for example, the holder 80 can receive the load from the bearing 6A at the portion that is structurally strong. The same also applies to the bearing 6B. Hence, damages caused by impacts from falls are less likely to be applied to the holder 80 retained by the pair of bearings 6A and 6B.

In other words, the recessed portion 682 is formed in the specific surface 681 in a region that is configured to oppose the distal end portion 862 (structurally weaker portion) of the holder 80 in the left-right direction. With this structure, load from the bearing 6A is prevented from being applied to the distal end portion 862 of the receiving portion 861 in the left-right direction. Accordingly, the holder 80 is less likely to be damaged by impacts from falling of the printing device 1.

The recessed portion 682 accounts for approximately one-third of the entire area of the specific surface 681. Here, referring to FIG. 9, assume an imaginary plane Q that includes the center axis P of the bearing 6A and that intersects with the top surface 691 which contacts the distal end portion 862. On the specific surface 681, portions configured to contact the receiving surface 866 (the contact surface 683 in the present embodiment) are positioned at both sides of the imaginary plane Q, while the recessed portion 682 is positioned adjacent to the top surface 691 that contacts the distal end portion 862 (structurally weaker portion of the fitting portion 86). The contact surface 683 of the bearing 6A can reliably contact the receiving surface 866 of the holder 80, thereby enabling the holder 80 to reliably disperse load received from the bearing 6A. Hence, this structure of the embodiment can better suppress the holder 80 from being damaged by the impacts from falls of the printing device 1.

Modification to the Embodiment

While the disclosure has been made in detail with reference to specific embodiment thereof, it would be apparent to those skilled in the art that many modifications and variations may be made therein without departing from the scope of the disclosure.

Figure 11:
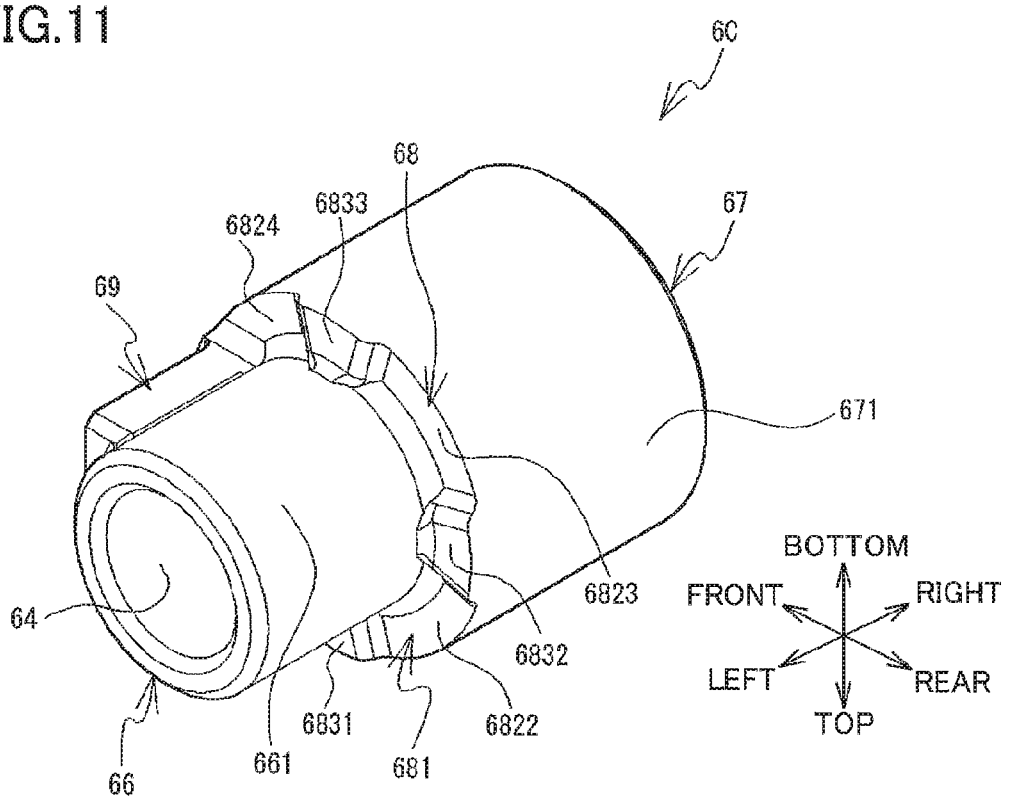
FIG. 11 is a perspective view of a bearing according to a modification to the embodiment.
Figure 12:
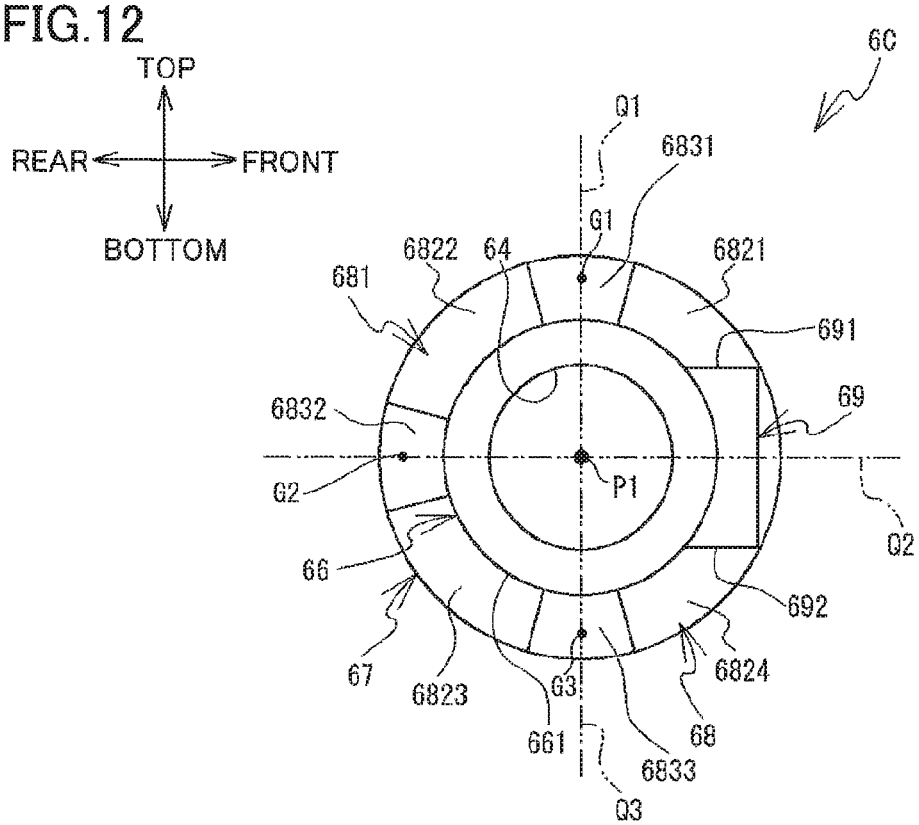
FIG. 12 is a left side view of the bearing according to the modification to the embodiment.

For example, the recessed portion 682 of the embodiment may be divided into two or more parts. FIGS. 11 and 12 illustrate a bearing 6C according to a modification to the embodiment. In the drawings and the following description, like parts and components having the same functions as those in the embodiment are designated with the same reference numerals to avoid duplicating description.

In the bearing 6C of the modification, four recessed portions 6821-6824 are formed in the specific surface 681 constituting the end face 68. In a left side view, referring to FIG. 12, the four recessed portions 6821-6824 are arranged in the counterclockwise direction at prescribed intervals from the top surface 691 of the protrusion 69 to the bottom surface 692 of the protrusion 69. Specifically, the recessed portions 6821-6824 are recessed rightward and arranged in the specific surface 681 sequentially in order from the recessed portion 6821 to the recessed portion 6824 in the counterclockwise direction in the left side view. The recessed portions 6821-6824 are arranged at equal intervals, and extend to have the same length as one another along the circumference of the small-diameter portion 66 in the left side view. The bearing 6C is symmetrical in the vertical direction.

Note that the recessed portions 6821-6824 may have different shapes and configurations from those of the disclosure. For example, the recessed portions may be arranged at different intervals and extend different lengths circumferentially. In other words, the bearing 6C need not have vertical symmetry.

Surfaces provided between neighboring two of the recessed portions 6821-6824 will be called partial contact surfaces; more specifically, a first partial contact surface 6831, a second partial contact surface 6832, and a third partial contact surface 6833. The partial contact surfaces 6831-6833 are arranged to occupy the same plane. Referring to FIG. 12, in the counterclockwise direction in a left side view, the first partial contact surface 6831 is formed between the recessed portion 6821 and the recessed portion 6822; the second partial contact surface 6832 is formed between the recessed portion 6822 and the recessed portion 6823; and the third partial contact surface 6833 is formed between the recessed portion 6823 and the recessed portion 6824. The protrusion 69 is disposed between the recessed portion 6824 and recessed portion 6821.

More specifically, the second partial contact surface 6832 and a portion of the third partial contact surface 6833 are disposed on opposite sides of a virtual plane Q1. Here, the virtual plane Q1 is an imaginary plane passing through a center axis P1 of the bearing 6C and intersecting with the first partial contact surface 6831. More precisely, in this modification, the virtual plane Q1 includes the center axis P1 of the bearing 6C and passing through a center of gravity G1 of the first partial contact surface 6831. Here, the portion of the third partial contact surface 6833 that is positioned opposite to the second partial contact surface 6832 with respect to the virtual plane Q1 is a frontward portion of the third partial contact surface 6833.

Similarly, the first partial contact surface 6831 and the third partial contact surface 6833 are disposed on opposite sides of a virtual plane Q2. The virtual plane Q2 is an imaginary plane including the center axis P1 of the bearing 6C and intersecting with the second partial contact surface 6832. More precisely, the virtual plane Q2 includes the center axis P1 of the bearing 6C and passing through a center of gravity G2 of the second partial contact surface 6832.

A portion of the first partial contact surface 6831 and the second partial contact surface 6832 are disposed on opposite sides of a virtual plane Q3. The virtual plane Q3 includes the center axis P1 of the bearing 6C and intersects with the third partial contact surface 6833. More precisely, the virtual plane Q3 includes the center axis P1 of the bearing 6C and passing through a center of gravity G3 of the third partial contact surface 6833. Here, the portion of the first partial contact surface 6831 that is positioned opposite to the second partial contact surface 6832 with respect to the virtual plane Q3 is a frontward portion of the first partial contact surface 6831.

Since methods for calculating positions of the center of gravities for the respective partial contact surfaces 6831-6833 are well known in the art, a description thereof has been omitted here. Further, the virtual planes Q1-Q3 may not pass through the centers of gravity G1, G2, G3 of the respective partial contact surfaces 6831-6833, but may pass through specific positions on respective inner surfaces of the partial contact surfaces 6831-6833. The specific positions may be determined arbitrary.

According to the structure of the bearing 6C of this modification, the three partial contact surfaces 6831-6833 can reliably and stably make surface contact with the receiving surface 866. The holder 80 can reliably disperse load received from the bearing 6C into the three surfaces, i.e., the partial contact surfaces 6831-6833. Hence, the printing device 1 according to this modification can suppress damage to the holder 80 caused by impacts from falling of the printing device 1.

In the depicted embodiment, the bearings 6A and 6B are distinctly shaped parts that are vertically asymmetrical. Hence, the bearing 6A must be assembled to the fitting portion 86 (on the right side), while the bearing 6B must be assembled to the fitting portion 87 (on the left side). Accordingly, there is a possibility that the bearings 6A and 6B may be incorrectly assembled. On the other hand, the bearing 6C of this modification is vertically symmetrical and therefore has the same shape regardless of whether the bearing 6C faces leftward or rightward. That is, the bearings 6C can be assembled to the fitting portion 86 as well as to the fitting portion 87. Accordingly, there is no chance that the bearings 6C are incorrectly assembled to the holder 80.

OTHER VARIATIONS

Figure 13:
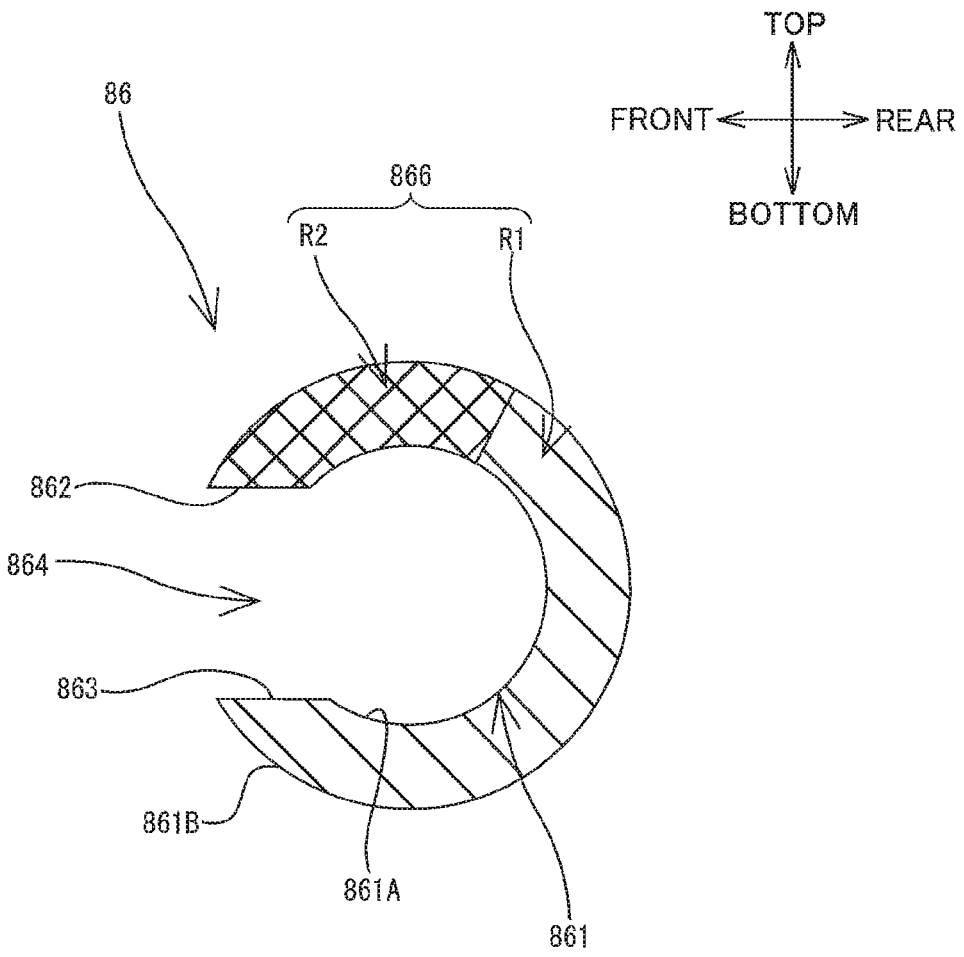
FIG. 13 is a view conceptually illustrating a fitting portion according to a variation of the embodiment.

While the recessed portion 682 is formed in the specific surface 681 on the end face 68 of the bearing 6A in the depicted embodiment, the recessed portion 682 may be formed in the receiving surface 866, rather than in the specific surface 681. In case that the receiving surface 866 includes a recessed portion, referring to FIG. 13, a recessed portion R2 should be formed on the receiving surface 866 in a region near the distal end portion 862, while a remaining region other than the recessed portion R2 (labelled R1 in FIG. 13) is configured to make contact with the specific surface 681, which serves as a contact surface of the bearing 6A, in the left-right direction. With this structure, the recessed portion R2 formed in the receiving surface 866 can function just as the recessed portion 682 formed in the specific surface 681 of the embodiment. Still alternatively, the recessed portion 682 may be formed in both of the specific surface 681 and the receiving surface 866. That is, the recessed portion 682 may be formed in at least one of the specific surface 681 and the receiving surface 866 so as to form a gap between the specific surface 681 and receiving surface 866 in the left-right direction.

The shape and layout position of the recessed portion 682 is not limited to those of the depicted embodiment. For example, the recessed portion 682 may extend a prescribed length circumferentially from a position spaced a prescribed distance away from the right edge of the top surface 691 constituting the protrusion 69. That is, preferably, the recessed portion 682 is arranged to at a position corresponding to a structurally weaker portion of the holder 80.

In the embodiment described above, the area of the recessed portion 682 is approximately one-third of the entire area of the specific surface 681. However, the area of the recessed portion 682 may be less than one-third, or more than one-third of the entire area of the specific surface 681. In case that the area of the recessed portion 682 is less than one-third of the entire area of the specific surface 681, the contact surface 683 is allowed to make contact with the receiving surface 866 with a larger area than in the depicted embodiment, ensuring stable contact between the contact surface 683 and the receiving surface 866. In case that the area of the recessed portion 682 extends to cover more than one-third of the entire area of the specific surface 681, the contact surface 683 can be prevented from making contact with a structurally weaker portion of the holder 80, even if the structurally weaker portion occupies a wider range on the receiving surface 866.

In the embodiment, the protrusion 69 of the small-diameter portion 66 covers approximately one-fourth of the circumference of the outer circumferential surface 661. However, the protrusion 69 may cover a different range of the circumference, but is preferably less than one-half of the circumference. Since the distance T1 between the distal end portions 862 and 863 of the receiving portion 861 is smaller than the outer diameter of the small-diameter portion 66, the protrusion 69 occupying less than one-half of the circumference of the outer circumferential surface 661 can still suppress the small-diameter portion 66 from coming forward through the opening 864.

While the holder 80 is formed as a separate member from the second cover 3 in the depicted embodiment, the holder 80 may be formed integrally with the second cover 3 instead. Further, while the fitting portions 86 and 87 are formed integrally with the holder 80, the fitting portions 86 and 87 may be formed as separate members from the holder 80. In this case, the fitting portions 86 and 87 may be fixed to the holder 80 with screws, for example.

While the printing device 1 of the embodiment employs thermal printing method, other printing method, such as thermal transfer printing or inkjet printing, may be employed. Further, the printing medium need not be wound up as a roll, as the roll 4A in the embodiment. Further, the open area 2A may not have a general rectangular shape in a top view, but may have any arbitrary shape. For example, one or more of the edge portions 21A, 23A, 24A, and 25A defining the open area 2A may be curved.

While the disclosure has been made in detail with reference to specific embodiment thereof, it would be apparent to those skilled in the art that various changes and modifications may be made therein without departing from the spirit and scope of the above described embodiment.

What is claimed is:

1. A printing device comprising:

a platen roller having a rotational shaft defining an axis extending in an axial direction, the rotational shaft having end portions in the axial direction;

a pair of bearings rotatably supporting the respective end portions of the rotational shaft, each of the bearings comprising:

a small-diameter portion having a generally cylindrical shape, the small-diameter portion having an outer circumferential surface;

a large-diameter portion having a generally cylindrical shape, the large-diameter portion having a diameter larger than a diameter of the small-diameter portion and being coaxially connected to the small-diameter portion, the larger-diameter portion having a peripheral surface and an end face connecting the peripheral surface to the outer circumferential surface of the small-diameter portion; and a protrusion provided at the outer circumferential surface of the small-diameter portion;

a holder including a pair of fitting portions, the pair of bearings being respectively fitted to the pair of fitting portions, each of the fitting portions comprising:

a receiving portion configured to receive the small-diameter portion of the corresponding bearing, the receiving portion having a generally C-shape when viewed in the axial direction and having a pair of distal end portions opposing each other to define a gap therebetween, the receiving portion being configured to contact the outer circumferential surface of the small-diameter portion;

an opening being the gap defined between the pair of distal end portions of the receiving portion, the protrusion of the corresponding bearing being fitted to the opening to prevent the bearing from rotating relative to the receiving portion; and a receiving surface configured to make contact with the end face of the large-diameter portion of the corresponding bearing from outward in the axial direction, at least one of the end face and the receiving surface including a recessed portion.

2. The printing device according to claim 1, wherein the end face of the large-diameter portion comprises:

a contact surface configured to make contact with the receiving surface of the holder; and the recessed portion, the recessed portion being configured to oppose at least one of the distal end portions of the receiving portion in the axial direction.

3. The printing device according to claim 2, wherein the recessed portion constitutes approximately one-third of an entire area of the end face.

4. The printing device according to claim 2, wherein the contact surface comprises at least three partial contact surfaces arranged to be spaced apart from one another in a circumferential direction of the large-diameter portion, the three partial contact surfaces including a first partial contact surface, a second partial contact surface and a third partial contact surface, wherein a portion of the second partial contact surface and a portion of the third partial contact surface are positioned opposite to each other with respect to an imaginary plane, the imaginary plane including a center axis of each bearing and passing through a center of gravity of the first partial contact surface.

5. The printing device according to claim 1, wherein the recessed portion is formed on the receiving surface in a region adjacent to at least one of the distal end portions of the receiving portion.

* * * * *